US009331399B2

(12) United States Patent
Itou et al.

(10) Patent No.: US 9,331,399 B2
(45) Date of Patent: May 3, 2016

(54) TERMINAL-FITTED WIRE MANUFACTURING METHOD

(75) Inventors: Akira Itou, Yokkaichi (JP); Kouichirou Goto, Yokkaichi (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 210 days.

(21) Appl. No.: 13/813,724

(22) PCT Filed: Jul. 28, 2011

(86) PCT No.: PCT/JP2011/067214

§ 371 (c)(1), (2), (4) Date: Feb. 1, 2013

(87) PCT Pub. No.: WO2012/043049

PCT Pub. Date: Apr. 5, 2012

(65) Prior Publication Data

US 2013/0175088 A1 Jul. 11, 2013

(30) Foreign Application Priority Data

Sep. 28, 2010 (JP) ..... 2010-216728

(51) Int. Cl.

| | |
|---|---|
| ***H01R 43/00*** | (2006.01) |
| ***H01R 3/00*** | (2006.01) |
| ***H01R 43/05*** | (2006.01) |
| ***H01R 4/72*** | (2006.01) |
| *H01R 4/18* | (2006.01) |

(52) U.S. Cl.

CPC .. *H01R 3/00* (2013.01); *H01R 4/72* (2013.01); *H01R 43/00* (2013.01); *H01R 43/005* (2013.01); *H01R 43/05* (2013.01); *H01R 4/185* (2013.01); *Y10T 29/49178* (2015.01)

(58) Field of Classification Search

CPC ..... H01R 4/72; H01R 13/5216; Y10T 29/49178; Y10T 29/49139; Y10T 29/49151; Y10T 29/49169; Y10T 29/49174; H02G 15/043; H02G 15/1806; Y10S 439/932

USPC ..... 29/859, 854, 857, 861, 868; 439/203, 439/287, 730, 877, 932

See application file for complete search history.

(56) References Cited

U.S. PATENT DOCUMENTS 7,294,008 B2 * 11/2007 Fukuyama ..... 439/287

FOREIGN PATENT DOCUMENTS

| | | |
|---|---|---|
| JP | 50-10542 | 4/1975 |
| JP | 10-289745 | 10/1998 |
| JP | 2000-285983 | 10/2000 |

OTHER PUBLICATIONS

International Search Report of Oct. 18, 2011.

*Primary Examiner* — Thiem Phan

(74) *Attorney, Agent, or Firm* — Gerald E. Hespos; Michael J. Porco; Matthew T. Hespos

(57) ABSTRACT

It is aimed to enable a heat shrinkable tube to be mounted on a connected part of a core exposed portion of a wire and a terminal with high positioning accuracy. A terminal-fitted wire manufacturing method is for mounting a heat shrinkable tube on a connected part of a core exposed portion of a wire and a terminal. After the wire is inserted into the heat shrinkable tube, the terminal is connected to the core exposed portion. Thereafter, the heat shrinkable tube is moved to a position for covering the connected part of the core exposed portion and the terminal, and a part of the heat shrinkable tube is temporarily fixed to at least parts of the wire and the terminal. Thereafter, the heat shrinkable tube is mounted by being heated and thermally shrunk.

2 Claims, 9 Drawing Sheets

TERMINAL-FITTED WIRE MANUFACTURING METHOD

BACKGROUND OF THE INVENTION

1. Field of the Invention

This invention relates to a technology for protecting a connected part of a wire and a terminal.

2. Description of the Related Art

Conventionally, a terminal-fitted wire disclosed in Japanese Unexamined Patent Publication No. 2000-285983 is known. In Japanese Unexamined Patent Publication No. 2000-285983, a crimping barrel of a ground terminal is crimped and connected to a core exposed at a wire end and a heat shrinkable tube is mounted on that crimped part.

The terminal-fitted wire on which the heat shrinkable tube is mounted as described above can be manufactured by the following process.

First, a long wire is cut to a predetermined length, a coating at a wire end portion is stripped to expose a core at the end portion. Subsequently, the wire end portion is inserted into a compression tube. Subsequently, a terminal is crimped and connected to the core exposed at the wire end portion. Thereafter, the compression tube is moved to cover a crimped part of the wire to the core. Thereafter, the compression tube is heated to shrink and deform. In this way, the terminal-fitted wire on which the heat shrinkable tube is mounted is manufactured.

In a state where the heat shrinkable tube before shrinkage is mounted on the crimped part, this heat shrinkable tube is movable relative to the crimped part. Thus, the heat shrinkable tube may move relative to the crimped part before shrinkage and may not be able to be accurately positioned with respect to the crimped part.

The above problem occurs because a time required for thermal shrinkage of the compression tube is longer than a time required for each operation performed earlier. For example, in a general wire end processing apparatus, a time required for each of a wire measuring operation, a cutting operation, a heat shrinkable tube fitting operation, a stripping operation, a crimping operation and an operation of mounting the heat shrinkable tube on a crimped part is approximately below 1 second and, at the longest, about several seconds. Contrary to this, an operation of thermally shrinking the heat shrinkable tube takes about 10 to 20 seconds. Thus, if the above series of operations are successively performed, other respective steps need to be performed in conformity with the time required for thermal shrinkage, which results in poor operation efficiency.

If a series of steps until the heat shrinkable tube is mounted on the crimped part and the step of thermally shrinking the heat shrinkable tube are separately performed to avoid this, each of the steps until the heat shrinkable tube is mounted on the crimped part can be efficiently performed.

However, in this case, the heat shrinkable tube mounted beforehand may move in a longitudinal direction of the wire between the series of steps until the heat shrinkable tube is mounted on the crimped part and the step of thermally shrinking the heat shrinkable tube, and it is difficult to position the heat shrinkable tube to accurately cover the crimped part.

Accordingly, an object of the present invention is to enable a heat shrinkable tube to be mounted on a connecting part of a core exposed portion of a wire and a terminal with high positioning accuracy.

SUMMARY OF THE INVENTION

To achieve the above object, the present invention is directed to a terminal-fitted wire manufacturing method for mounting a heat shrinkable tube on a connected part of a core exposed portion of a wire and a terminal, comprising (a) inserting the wire into the heat shrinkable tube; (b) connecting the terminal to the core exposed portion of the wire; (c) moving the heat shrinkable tube to a position for covering the connected part of the core exposed portion and the terminal; (d) temporarily fixing a part of the heat shrinkable tube to at least parts of the wire and the terminal; and (e) mounting the heat shrinkable tube on the connected part of the core exposed portion and the terminal by heating and thermally shrinking the heat shrinkable tube.

According to the above-described terminal-fitted wire manufacturing method, the heat shrinkable tube is mounted on the connected part of the core exposed portion and the terminal by being heated and thermally shrunk after the part of the heat shrinkable tube is temporarily fixed to at least the parts of the wire and the terminal. Thus, the heat shrinkable tube is unlikely to be displaced even if the wire or the like is moved after the heat shrinkable tube is temporarily fixed. Therefore, the heat shrinkable tube can be mounted on the connected part of the core exposed portion of the wire and the terminal with high positioning accuracy.

The terminal-fitted wire manufacturing may include forming an adhesive layer or a glue layer on an inner peripheral portion of the heat shrinkable tube; and the part of the heat shrinkable tube is temporarily fixed to at least the parts of the wire and the terminal by the adhesive layer or the glue layer in the step (d). Accordingly the heat shrinkable tube can be easily temporarily fixed without being thermally shrunk.

The part of the heat shrinkable tube that is temporarily fixed to at least the parts of the wire and the terminal may be heated and thermally shrunk in the step (d). Accordingly, the heat shrinkable tube can be easily temporarily fixed without using an adhesive layer or the like since the part of the heat shrinkable tube is temporarily fixed to at least the parts of the wire and the terminal by being heated and thermally shrunk.

The invention also is directed to a terminal-fitted wire, comprising a wire including a core exposed portion; a terminal connected to the core exposed portion; and a heat shrinkable tube arranged to cover a connected part of the core exposed portion and the terminal and partly temporarily fixed to at least parts of the wire and the terminal.

Accordingly, the heat shrinkable tube is temporarily fixed to the connected part with high positioning accuracy since the terminal-fitted wire includes the heat shrinkable tube arranged to cover the connected part of the core exposed portion and the terminal and partly temporarily fixed to at least the parts of the wire and the terminal. Thus, this heat shrinkable tube can be mounted on the connected part of the core exposed portion of the wire and the terminal with high positioning accuracy.

DETAILED DESCRIPTION OF THE PREFERRED EMBODIMENTS

Hereinafter, a terminal-fitted wire manufacturing method and a terminal-fitted wire according to an embodiment are described.

Figure 1:
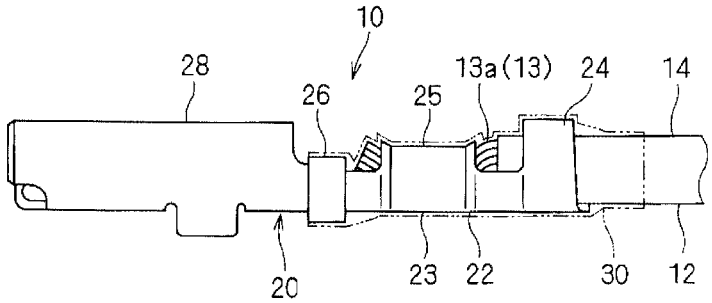
FIG. 1 is a side view showing a terminal-fitted wire as a subject matter.

First, the terminal-fitted wire is described. FIG. 1 is a side view showing a terminal-fitted wire 10. The terminal-fitted wire 10 includes a wire 12, a terminal 20 and a heat shrinkable tube 30.

The wire 12 is formed such that the outer periphery of a core 13 is covered by a coating 24 by extrusion coating. The core 13 is formed by a single metal wire of copper, copper alloy, aluminum, aluminum alloy or the like or by twisting wires of such a metal. In this example, the core 13 is formed by twisting a plurality of metal wires of aluminum or aluminum alloy. Further, the coating 14 is stripped at an end portion of the wire 12, whereby a core exposed portion 13*a* is formed at the end portion of the wire 12.

The terminal 20 is formed, such as by appropriately press-working a metal plate material of copper, copper alloy or the like. A plating layer of tin, nickel or the like may be formed on the surface of the terminal 20. In this example, a tin plating layer is formed on the surface of the terminal 20.

The terminal 20 includes a wire connecting portion 22 and a mating connecting portion 28.

The mating connecting portion 28 is a part to be connected to a mating terminal or the like and, here, substantially in the form of a tube, i.e. in the form of a female terminal. A mating terminal (so-called male terminal) including a pin-shaped or tab-shaped connected part is inserted into this mating connecting portion 28 for connection. However, the mating connecting portion 28 may be in the form of a pin or a tab, i.e. in the form of a male terminal or may be formed into an annular shape connectable to a mating member by a screw or the like.

The wire connecting portion 22 is connectable to the end portion of the wire 12. Here, the wire connecting portion 22 includes a bottom plate portion 23, a pair of coating crimping pieces 24 and a pair of core crimping pieces 25. The bottom plate portion 23 is in the form of a long plate extending toward a base end part of the mating connecting portion 28. The integral coating crimping pieces 24 are in the form of long pieces extending from opposite sides of an end part of the bottom plate portion 23. A part of the wire connecting portion 22 where the pair of coating crimping pieces 24 are formed has a substantially U-shaped cross-section. The pair of core crimping pieces 25 are in the form of long pieces extending from opposite sides of the end part of the bottom plate portion 23 between the pair of coating crimping pieces 24 and the mating connecting portion 28. A part of the wire connecting portion 22 where the pair of core crimping pieces 25 are formed has a substantially U-shaped cross-section.

Further, a peripheral wall portion 26 is formed at a part of the bottom plate portion 23 of the wire connecting portion 22 between the pair of core crimping pieces 25 and the mating connecting portion 28. The peripheral wall portion 26 is a jaw-shaped portion bulging out over the entire outer periphery of the bottom plate portion 23 between the pair of core crimping pieces 25 and the mating connecting portion 28. The peripheral wall portion 26 is held in close contact with the outer peripheral surface of the bottom plate portion 23. The outer periphery of the peripheral wall portion 26 has a ring shape or an annular shape such as a rectangular ring shape with rounded corners. Such a peripheral wall portion 26 can be formed, for example, by being molded of resin in a state where the terminal 20 is fixed in a resin forming mold (so-called insert molding). Thermoplastic resins such as polyamide, polyester, polypropylene and polyethylene, thermosetting resins such as epoxy resin can be used as the resin for forming the peripheral wall portion 26.

The pair of core crimping pieces 25 are crimped and connected to the core exposed portion 13*a* to embrace the core exposed portion 13*a* and the pair of coating crimping pieces 24 are crimped and connected to the coating 14 to embrace an end part of the coating 14, whereby the end portion of the wire 12 and the terminal 20 are connected. However, connection of the wire 12 and the terminal 20 is not limited to crimp connection, but may be bonded by welding such as ultrasonic welding or resistance welding or soldering.

Further, the heat shrinkable tube 30 is in the form of a tube which covers at least a contact part of the core exposed portion 13*a* and the terminal 20 (particularly, a part where the pair of core crimping pieces 25 are crimped and connected to the core exposed portion 13*a*). Here, the heat shrinkable tube 30 covers a connected part of the end portion of the wire 12 and the terminal 20 between a part of the coating 14 of the wire 12 near the wire connecting portion 22 and the peripheral wall portion 26.

Figure 2:
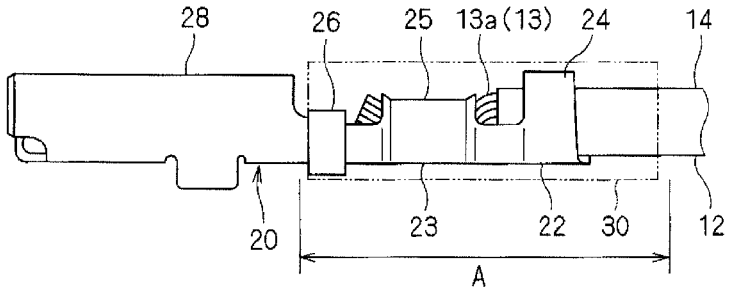
FIG. 2 is a view showing a permissible range in which a heat shrinkable tube before thermal shrinkage can be mounted.

Such a heat shrinkable tube 30 is formed of a tubular member which shrinks upon heating, has a length equal to or longer than a length from the part of the coating 14 of the wire 12 near the wire connecting portion 22 to the peripheral wall portion 26 before heating, and is formed into a tubular shape having such an inner diameter that the crimped part of the pair of the coating crimping pieces 24 and the crimped part of the pair of core crimping pieces 25 are insertable. As shown in FIG. 2, the connected part of the end portion of the wire 12 and the terminal 20 is inserted and arranged into the heat shrinkable tube 30 before heating and the part of the coating 14 of the wire 12 near the wire connecting portion 22 and the peripheral wall portion 26 are respectively arranged in end parts of the heat shrinkable tube 30. When the heat shrinkable tube 30 is heated in this state, it thermally shrinks to be mounted on the connected part of the end portion of the wire 12 and the terminal 20 while covering this connected part. In this example, one end part of the heat shrinkable tube 30 is held in close contact with the outer peripheral surface of the peripheral wall portion 26 and the other end part thereof is held in close contact with the outer peripheral surface of the coating 14 in this mounted state. In this way, the both end parts of the heat shrinkable tube 30 are sealed and the connected part is more reliably made waterproof. An intermediate part of the heat shrinkable tube 30 is preferably held in close contact with the outer peripheral surface of the connected part, but may cover with an appropriate clearance formed between the heat shrinkable tube 30 and this outer peripheral surface.

To realize reliable waterproofing by the above heat shrinkable tube 30, it is preferable to arrange the peripheral wall portion 26 in the one end part of the heat shrinkable tube 30 and arrange the part of the coating 14 near the terminal 20 in the other end part of the heat shrinkable tube 30. To this end, the heat shrinkable tube 30 before thermal shrinkage is preferably arranged in a predetermined permissible range A (see FIG. 2) with respect to the connected part of the end portion of the wire 12 and the terminal 20 with high positioning accuracy. A method for manufacturing the terminal-fitted 10 for that purpose is described below.

Here is described the method for manufacturing the terminal-fitted wire 10 while accurately maintaining the position of the heat shrinkable tube 30 with respect to the connected part of the end portion of the wire 12 and the terminal 20.

Specifically, the above heat shrinkable tube 30 is roughly mounted on the connected part of the end portion of the wire 12 and the terminal 20 as follows. First, the wire 12 is inserted into the heat shrinkable tube 30 before thermal shrinkage (step (a)). Then, the terminal is connected to the core exposed portion 13*a* of the wire 12 (step (b)). Subsequently, the heat shrinkable tube 30 is moved to a position for covering the connected part of the core exposed portion 13*a* and the terminal 20 (step (c)). Thereafter, by thermally shrinking the heat shrinkable tube 30, the heat shrinkable tube 30 is mounted on the connected part of the core exposed portion 13*a* and the terminal 20 (step (e)). Even if the heat shrinkable tube 30 is accurately moved to the connected part in the above step (c), it is necessary to prevent a displacement of the heat shrinkable tube 30 until the step (e) is performed.

Accordingly, a part of the heat shrinkable tube 30 is temporarily fixed to at least parts of the wire 12 and the terminal 20 here (step (d)) after the above step (c). A specific method for temporary fixing is described in detail later. This suppresses a displacement of the heat shrinkable tube 30 relative to the connected part even if the terminal-fitted wire 10 is moved until the step (e) is performed after the step (c). Accordingly, the heat shrinkable tube 30 can be mounted on the connected part of the end portion of the wire 12 and the terminal 20 with high positioning accuracy. In addition, since the part of the heat shrinkable tube 30 is temporarily fixed to at least the parts of the wire 12 and the terminal 20 in the step (d), this step can be more quickly performed as compared with the case where the heat shrinkable tube 30 is entirely thermally shrunk. More specifically, the above step (d) can be performed for a period nearly equal to the time required for a wire measuring operation, a cutting operation, a heat shrinkable tube fitting operation, a stripping operation, a crimping operation, an operation of mounting the heat shrinkable tube on a crimped part and the like (approximately below 1 second, at the longest about several seconds). Thus, the steps (a) to (d), more preferably together with the wire measuring operation and the cutting operation performed earlier can be successively performed with high operation efficiency as a series of steps. Further, the step (e) can also be efficiently performed as an operation (outside operation) different from a series of operations of the steps (a) to (d) such as by collectively heating a plurality of terminal-fitted wires 10.

The above method for manufacturing the terminal-fitted wire 10 is described in the overall process from the operation of measuring and cutting the long wire to the manufacturing of the terminal-fitted wire 10. Note that movable parts such as feed rollers 42, wire chucks 46 and tube chucks 50 operate by driving various driving mechanisms such as motors, hydraulic cylinders, air cylinders and the like and those operations can be automatically controlled by an unillustrated control unit.

Figure 3:
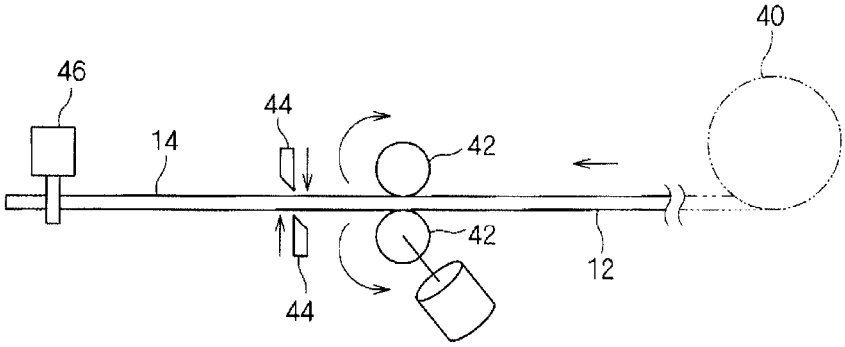
FIG. 3 is a view showing a terminal-fitted wire manufacturing process.
Figure 4:
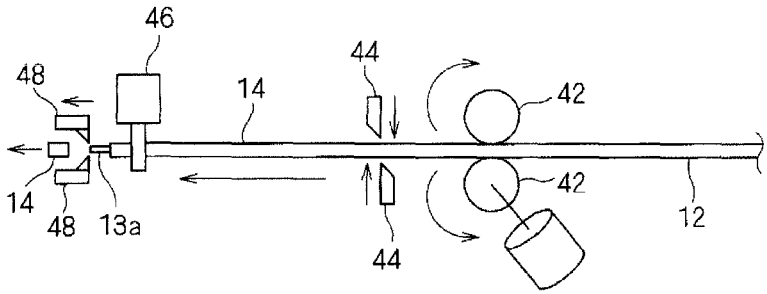
FIG. 4 is a view showing the terminal-fitted wire manufacturing process.

First, as shown in FIG. 3, a long wire 12 wound and accommodated on a reel 40 is fed toward a position between a pair of cutting blades 44 by a pair of feed rollers 42 and the like. Then, as shown in FIG. 4, a coating 14 of a leading end portion of the wire 12 is removed by a pair of stripping blades 48 in a state where the wire 12 is clamped at a position slightly before the leading end portion of the wire 12 by the wire chuck 46. In this way, a core exposed portion 13*a* having a predetermined length is formed at one end portion of the wire 12.

Figure 5:
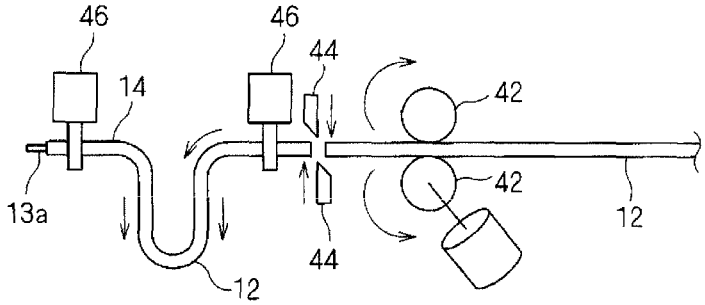
FIG. 5 is a view showing the terminal-fitted wire manufacturing process.

Subsequently, as shown in FIG. 5, the wire 12 is further fed by the pair of feed rollers 42, the fed wire 12 is clamped by another wire chuck 46 near the pair of cutting blades 44 when the wire 12 is cut to a predetermined length, and the wire 12 is cut by the pair of cutting blades 44 in this state. In this way, the wire 12 is cut to a desired length.

Figure 6:
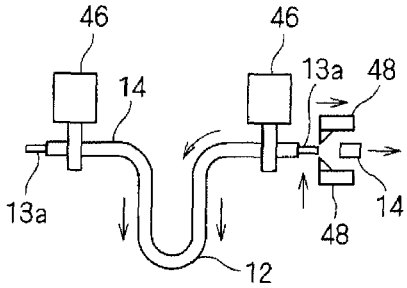
FIG. 6 is a view showing the terminal-fitted wire manufacturing process.

Subsequently, as shown in FIG. 6, the coating 14 of the wire 12 at the other end portion is removed by the pair of stripping blades 48. In this way, a core exposed portion 13*a* of a predetermined length is formed also at the other end portion of the wire 12.

Figure 7:
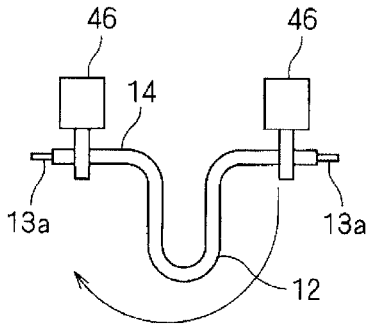
FIG. 7 is a view showing the terminal-fitted wire manufacturing process.
Figure 8:
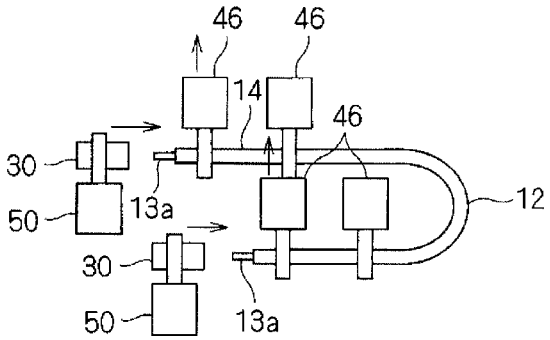
FIG. 8 is a view showing the terminal-fitted wire manufacturing process.
Figure 9:
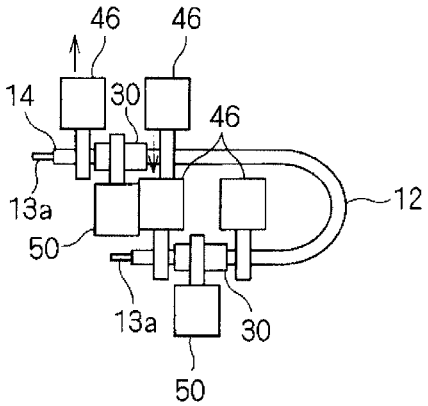
FIG. 9 is a view showing the terminal-fitted wire manufacturing process.

Subsequently, as shown in FIG. 7, the other end portion and the one end portion of the wire 12 are aligned. Then, as shown in FIG. 8, heat shrinkable tubes 30 clamped by the tube chucks 50 are moved toward the end portions of the wire 12 with each end portion of the wire 12 clamped by two wire chucks 46. At this time, the wire 12 is released from the wire chuck 46 closer to each core exposed portion 13*a* out of the two wire chucks 46 and this wire chuck 46 is temporarily moved and retracted from the wire 12. Then, as shown in FIG. 9, the moved and retracted wire chucks 46 are returned to clamp the wire 12 again with the heat shrinkable tubes 30 pushed to positions near the other wire chucks 46. Thereafter, the heat shrinkable tubes 30 are released from the tube chucks 50 and these tube chucks 50 are moved and retracted. Note that the wire 12 is preferably inserted into the heat shrinkable tube 30 before the terminal 20 is crimped to smoothly insert the wire 12 into the heat shrinkable tube 30, but this is not essential.

Figure 10:
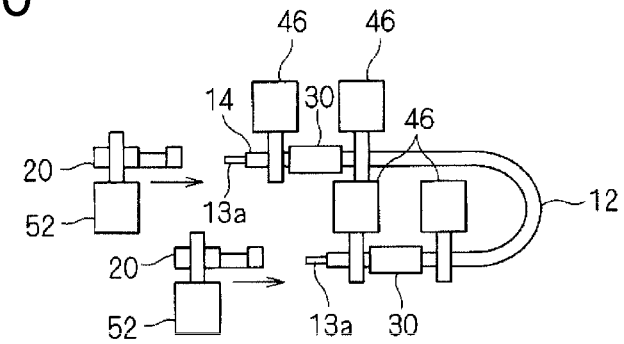
FIG. 10 is a view showing the terminal-fitted wire manufacturing process.

Subsequently, as shown in FIG. 10, terminals 20 clamped by terminal chucks 52 are moved toward the core exposed portions 13*a* and the core exposed portions 13*a* are arranged in wire connecting portions 22 of the terminals 20.

Figure 11:
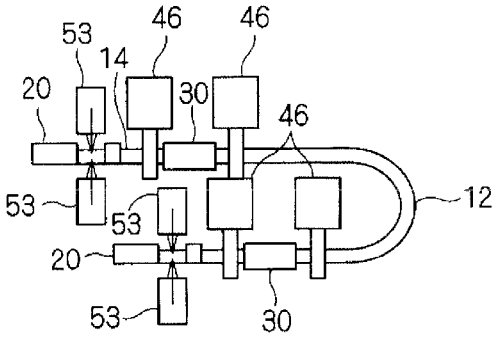
FIG. 11 is a view showing the terminal-fitted wire manufacturing process.

Thereafter, as shown in FIG. 11, a pair of coating crimping pieces 24 and a pair of core crimping pieces 25 of each wire connecting portion 22 are sandwiched between a pair of crimping dies 53 and crimped and deformed. In this way, the wire connecting portion 22 is crimped and connected to the core exposed portion 13*a*.

Figure 12:
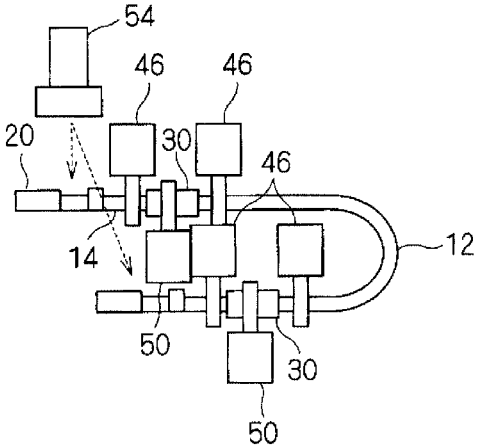
FIG. 12 is a view showing the terminal-fitted wire manufacturing process.

Thereafter, as shown in FIG. 12, an image of a connected part of the wire connecting portion 22 and the core exposed portion 13*a* is captured by an imaging camera 54 or the like. The captured image is used for various image inspection processings concerning a crimped state, the position of the terminal and the like.

Figure 13:
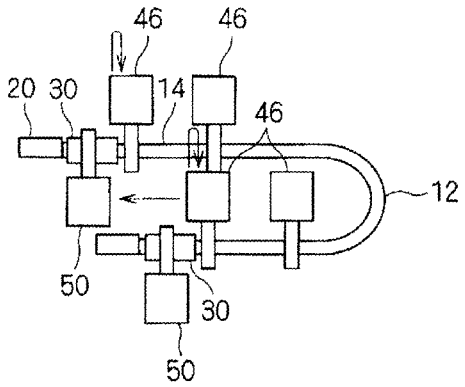
FIG. 13 is a view showing the terminal-fitted wire manufacturing process.

Thereafter, as shown in FIG. 13, the wire chucks 46 closer to the terminals 20 are temporarily moved and retracted and the heat shrinkable tubes 30 are clamped by the tube chucks 50 and moved toward the terminals 20. In this way, the heat shrinkable tubes 30 are moved to positions for covering the connected part of the core exposed portion 13*a* and the terminal 20.

Figure 14:
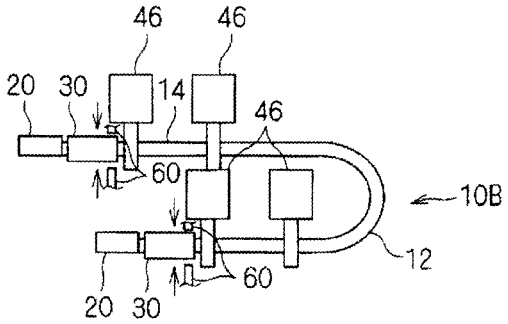
FIG. 14 is a view showing the terminal-fitted wire manufacturing process.
Figure 16:
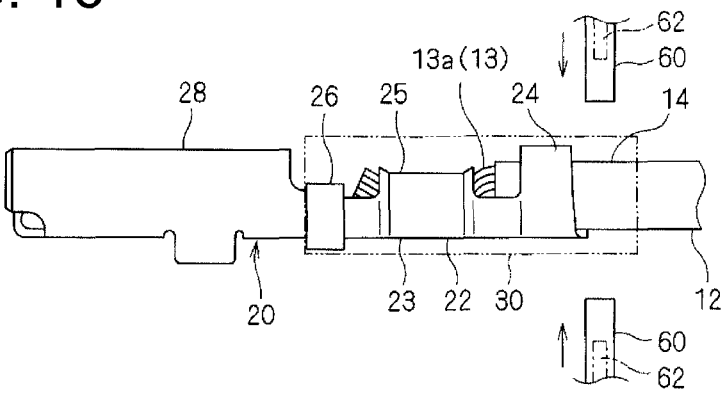
FIG. 16 is a view showing a temporary fixing step.
Figure 17:
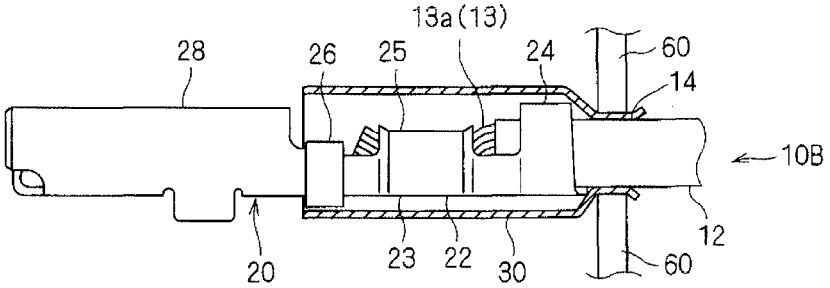
FIG. 17 is a view showing the temporary fixing step.
Figure 18:
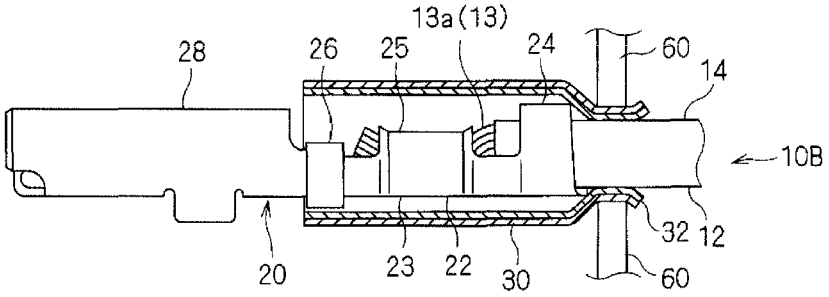
FIG. 18 is a view showing another temporary fixing step.

Then, as shown in FIG. 14, parts of the heat shrinkable tubes 30 are temporarily fixed to at least parts of the wire 12 and the terminals 20 by partly pressing the heat shrinkable tubes 30. In this way, a terminal-fitted wire 10B to which the heat shrinkable tubes 30 are temporarily fixed is manufactured. This operation can be performed by locally sandwiching parts of the heat shrinkable tubes 30 covering the end parts of the coating 14 while heating them by a pair of heating dies 60, for example, as shown in FIGS. 16 and 17. A heating temperature is preferably as short a time as possible without causing any large external damage of the heat shrinkable tubes 30 by heat. Preferably, the range of the heating temperature is, for example, a range of 80° C. to 180° C., but there is no limitation to this range depending on other factors such as the material and shape of the heat shrinkable tubes 30. At least leading end parts of the pair of heating dies 60 are formed to be plate-like. These leading end parts have such a thickness that the heat shrinkable tubes 30 can be partly heated and pressed, here a thickness smaller than the length of the parts of the heat shrinkable tubes 30 covering the end parts of the coating 14. Further, the pair of heating dies 60 are heated by a heating device 62 such as a ceramic heater. The part of the heat shrinkable tube 30 covering the end part of the coating 14 is partly thermally shrunk and temporarily fixed to the coating 14 by being sandwiched between the pair of heating dies 60. Note that the part of the heat shrinkable tube 30 needs not be thermally shrunk to such a degree as to be completely held in close contact with the coating 14, and may be thermally shrunk to such a degree as to be able to position the heat shrinkable tube 30. Note that the other part of the heat shrinkable tube 30 is not basically thermally shrunk except at a part where heat of the pair of heating dies 60 has been transferred.

Since the step of temporarily fixing the heat shrinkable tube 30 as described above is a step of partly thermally shrinking the heat shrinkable tube 30, this step requires a shorter time as compared with the step of thermally shrinking the entire heat shrinkable tube 30 and can be performed for an operation period nearly equal to those required for the respective steps shown in FIGS. 3 to 13. Thus, following a series of steps shown in FIGS. 3 to 13, the temporary fixing step can be efficiently performed.

Note that a tube inner layer 32, which is an adhesive layer or a glue layer, may be formed on the inner periphery of the heat shrinkable tube 30. This tube inner layer 32 is a layer which notably becomes adhesive or sticky upon heating and functions to maintain a waterproof property by being reliably held in close contact with the surface of the connected part in a state where the heat shrinkable tube 30 is mounted on the connected part of the end portion of the wire 12 and the terminal 20. When the heat shrinkable tube 30 is formed with the above tube inner layer 32, if a part of the heat shrinkable tube 30 is heated by the pair of heating dies 60 in the same manner as above, the tube inner layer 32 is heated and the part of the heat shrinkable tube 30 is adhered or stuck to the coating 14 to be temporarily fixed by the tube inner layer 32 that is the adhesive layer or the glue layer. Thus, the heat shrinkable tube 30 can be temporarily fixed and positioned within a relatively short period in the same manner as described above. Note that the adhesive layer or the glue layer may be adhesive or sticky even under normal temperature, and this heat shrinkable tube 30 may be partly temporarily fixed only by pressing the heat shrinkable tube 30 without heating it.

Figure 19:
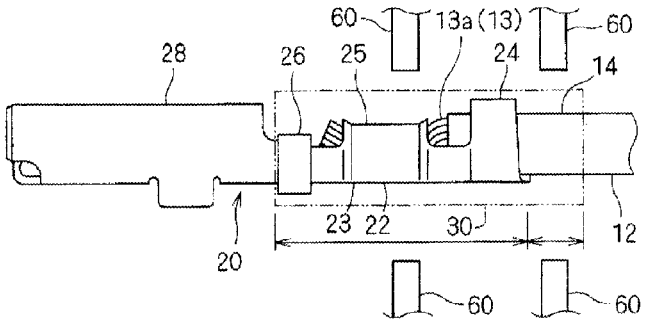
FIG. 19 is a view showing an example of a temporary fixing position.

Note that the heat shrinkable tube 30 may be temporarily fixed at any part thereof. For example, as shown in FIG. 19, a pair of heating dies 60 may be arranged in a range of the coating 14 to which the terminal 20 is not crimped and connected and a part of the heat shrinkable tube 30 on the side of the wire 12 may be temporarily fixed to the coating 14. Alternatively, a pair of heating dies 60 may be arranged in a range where the wire connecting portion 22 of the terminal 20 is present and a part of the heat shrinkable tube 30 on the side of the terminal 20 may be temporarily fixed to the wire connecting portion 22 of the terminal 20 and the core exposed portion 13*a* connected thereto or the peripheral wall portion 26 or the like. In short, it is sufficient to temporarily fix not the entire heat shrinkable tube 30, but a part of the heat shrinkable tube 30 to parts of the wire 12 and the terminal 20 by thermal shrinkage, adhesive, glue or the like.

Figure 20:
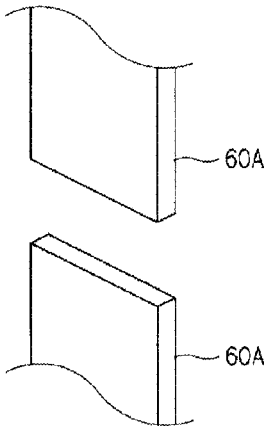
FIG. 20 is a view showing an example of heating dies.
Figure 21:
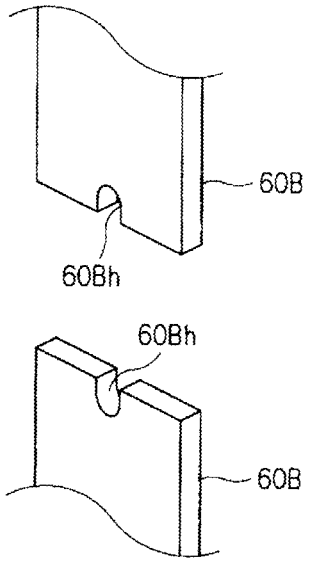
FIG. 21 is a view showing another example of the heating dies.
Figure 22:
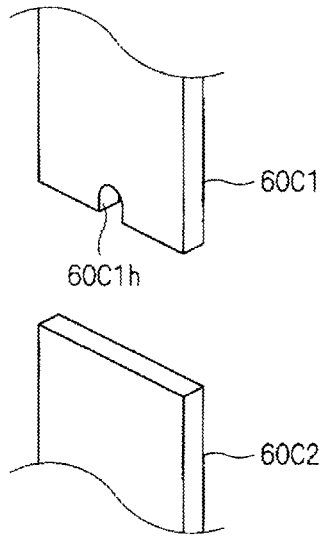
FIG. 22 is a view showing still another example of the heating dies.

Further, the pair of heating dies 60 may have any shape if they can press the heat shrinkable tube 30. For example, as shown in FIG. 20, leading end parts of a pair of heating dies 60A may have a linear shape. Further, as shown in FIG. 21, semicircular recesses 60Bh may be formed on leading end parts of a pair of heating dies 60B and the heat shrinkable tube 30 may be arranged in these semicircular recesses 60Bh and pressed. The semicircular recesses 60Bh may have a semicircular shape having a diameter larger than (normally slightly larger) than the diameter of the coating 14 of the wire 12 with which the heat shrinkable tube 30 to be thermally shrunk and pressed is to be held in close contact. Further, as shown in FIG. 22, a semicircular recess 60C1*h* similar to the above semicircular recesses 60Bh may be formed on a leading end part of one (upper) heating die 60C1 and a leading end part of the other (lower) heating die 60C2 may have a linear shape.

Figure 15:
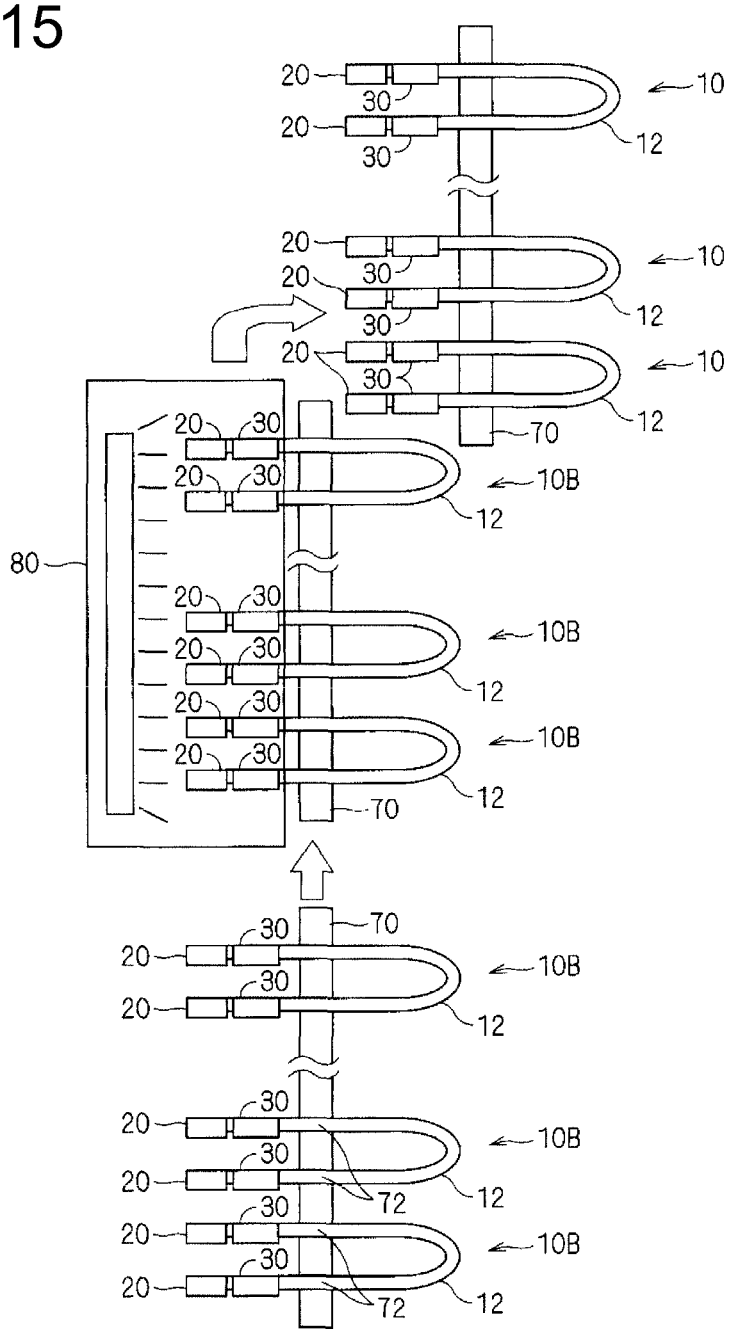
FIG. 15 is a view showing the terminal-fitted wire manufacturing process.

After the heat shrinkable tube 30 is temporarily fixed as described above, the entire heat shrinkable tube 30 is heated and thermally shrunk as shown in FIG. 15, whereby the heat shrinkable tube 30 is mounted on the connected part of the end part of the wire 12 and the terminal 20.

This step can be performed for a plurality of terminal-fitted wires 10B to both end parts of which the heat shrinkable tubes 30 are temporarily fixed. For example, a wire end holding device 70 including a plurality of holding portions 72 capable of holding the end parts of the wires 12 is prepared, and a plurality of terminal-fitted wires 10B to which the heat shrinkable tubes 30 are temporarily fixed are set in the wire end holding device 70. A configuration for sandwiching the end part of the wire 12 by a pair of resilient plates or the like can be, for example, adopted for the holding portion 72. The wire end holding device 70 is arranged before a heating device 80 such as a far-infrared heating device and a plurality of heat shrinkable tubes 30 are collectively entirely heated. In this way, the heat shrinkable tube 30 can be mounted on each of the plurality of terminal-fitted wires 10B by being entirely thermally shrunk. That is, the plurality of heat shrinkable tubes 30 can be entirely thermally shrunk and mounted together on the terminal-fitted wires 10B which are successively manufactured within a relatively short period and to which the heat shrinkable tubes 30 are temporarily fixed. That is, a time for manufacturing one terminal-fitted wire 10B by way of the steps shown in FIGS. 3 to 14 (also referred to as "takt time") and a time required to manufacture one terminal-fitted wire 10 on which the heat shrinkable tubes 30 are mounted by the step of FIG. 15 can be made substantially equal, and production efficiency can be improved.

According to the manufacturing method for the terminal-fitted wire 10 configured as described above and the terminal-fitted wire 10B to which the heat shrinkable tubes 30 are temporarily fixed, after parts of the heat shrinkable tubes 30 are temporarily fixed to at least parts of the wire 12 and the terminals 20, the heat shrinkable tubes 30 are heated and thermally shrunk to be mounted. Thus, after being temporarily fixed, the heat shrinkable tubes 30 are unlikely to be displaced even if the wire 12 is moved. Therefore, the heat shrinkable tubes 30 can be mounted on the connected parts of the core exposed portions 13*a* of the wire 12 and the terminals 20 with high positioning accuracy.

Note that a case is assumed in the above embodiment where the core 13 is made of aluminum or aluminum alloy and the tin-plating layer is formed on the copper or copper alloy surface of the terminal 20. In the terminal-fitted wire 10 thus configured, a potential difference between the terminal 20 and the core 13 is relatively large. Thus, if moisture adheres to the connected part of the terminal 20 and the core 13, this moisture may function as electrolytic solution to cause electrolytic corrosion. Accordingly, this electrolytic corrosion can be more reliably suppressed by accurately mounting the heat shrinkable tube 30 on the connected part (particularly contact part) of the core 13 and the terminal 20.

However, the above manufacturing method is not limited to the case where the core 13 is made of aluminum, aluminum alloy or the like. Further, the peripheral wall portion 26 of the terminal 20 may be omitted. That is, the heat shrinkable tubes 30 themselves are mounted on connected parts of various wires and various terminals for various purposes such as for waterproofing purpose, for insulation purpose and for protection purpose from external damage. The above manufacturing method and the like can be adopted for operations in general of mounting such heat shrinkable tubes 30.

Note that the respective configurations described in the above respective embodiments and the respective modifications thereof can be appropriately combined without contracting with each other.

Although this invention has been described in detail as described above, the above description is illustrative in all aspects and this invention is not limited to that. It should be appreciated that unillustrated innumerable modifications can be envisaged without departing from the scope of this invention.

The invention claimed is:

1. A terminal-fitted wire manufacturing method for mounting at least one heat shrinkable tube on a connected part of a core exposed portion of at least one wire and at least one terminal, comprising:

(a) stripping a coating of a leading end portion of the at least one wire to define the core exposed portion;

(b) inserting the leading end of the at least one wire into the at least one heat shrinkable tube that has an adhesive layer formed on an inner peripheral portion thereof;

(c) connecting the at least one terminal to the core exposed portion of the at least one wire;

(d) moving the at least one heat shrinkable tube to a position for covering the connected part of the core exposed portion and the at least one terminal and part of the coating adjacent the core exposed portion;

(e) fixing a part of the heat shrinkable tube to the coating by selectively pressing and heating the part of the heat shrinkable tube so that the adhesive layer contacts and adhesively engages and thermally shrinks about the coating;

(f) moving the at least one wire and the at least one terminal, with the at least one heat shrinkable tube temporarily fixed thereto, to a heating element; and (g) permanently mounting the at least one heat shrinkable tube onto the connected part of the core exposed portion of the at least one wire and the at least one terminal by heating and thermally shrinking the heat shrinkable tube into engagement with the core exposed portion of the at least one wire.

2. The terminal-fitted wire manufacturing method according to claim 1, wherein the at least one heat shrinkable tube, the at least one wire, and the at least one terminal comprise a plurality of heat shrinkable tubes, a plurality of wires, and a plurality of terminals, respectively;

the wires are arranged at the heating element, in a state in which each of the wires is connected to one of the plurality of terminals with the plurality of heat shrinkable tubes temporarily fixed thereto; and the plurality of heat shrinkable tubes are mounted to the connected part of the core exposed portion of the wires and the plurality of terminals in unison.

* * * * *